US009987540B1

(12) United States Patent
Giusto

(10) Patent No.: US 9,987,540 B1
(45) Date of Patent: Jun. 5, 2018

(54) JUGGLING PRACTICE TOOL

(71) Applicant: Christopher Giusto, Warwick, RI (US)

(72) Inventor: Christopher Giusto, Warwick, RI (US)

( * ) Notice: Subject to any disclaimer, the term of this patent is extended or adjusted under 35 U.S.C. 154(b) by 247 days.

(21) Appl. No.: 15/000,416

(22) Filed: Jan. 19, 2016

(51) Int. Cl.
*A63B 69/00* (2006.01)
*A63B 67/08* (2006.01)

(52) U.S. Cl.
CPC ..... *A63B 69/00* (2013.01); *A63B 67/08* (2013.01)

(58) Field of Classification Search
USPC ..... 434/247, 258; 482/148; 224/600, 604, 224/611; 446/491
See application file for complete search history.

(56) References Cited

U.S. PATENT DOCUMENTS 306,863 A 10/1884 Robinson
719,810 A * 2/1903 Jones ..... A45F 3/02 193/7
1,454,779 A 5/1923 Wade
1,589,077 A 6/1926 Hooper
1,645,360 A * 10/1927 Taylor ..... A01D 46/22 224/611
1,875,585 A * 9/1932 Freimann ..... A01D 46/22 224/611
1,992,849 A * 2/1935 Walter ..... A01D 46/22 224/630
1,994,362 A * 3/1935 Kavanagh ..... A01D 46/22 224/610
2,163,501 A * 6/1939 Speicher ..... A01D 46/22 224/640
2,943,432 A 7/1960 Colon
3,705,485 A * 12/1972 Toomer ..... A01D 46/22 56/330
4,925,071 A * 5/1990 Fleming ..... A01D 46/22 224/236
5,088,634 A 2/1992 MacLaren
5,201,446 A * 4/1993 Martin ..... A01D 46/22 206/523
D389,665 S 1/1998 Ackerman
6,866,269 B2 * 3/2005 Liebau ..... A63B 21/0088 273/440
9,271,558 B1 * 3/2016 Sandford ..... A45F 3/04
2009/0199532 A1 8/2009 Earle-Richardson
2011/0136087 A1 * 6/2011 Corridon ..... A63B 69/00 434/247

* cited by examiner

*Primary Examiner* — Kurt Fernstrom
(74) *Attorney, Agent, or Firm* — Kyle A. Fletcher, Esq.

(57) ABSTRACT

The juggling practice tool is a device that is designed to collect objects that are dropped in the course of practicing juggling. The juggling practice tool is a catch basin that is worn by the juggler during the practice session. The catch basin is attached to the juggler through the use of a plurality of shoulder straps, a waist belt, and a belt connector. The plurality of shoulder straps and the waist belt hold the catch basin perpendicular to the plane of juggling in such a way that when a juggled object is dropped the catch basin catches and hold the dropped juggled object in a location readily accessible to the juggler. The juggling practice tool comprises a catch basin, a plurality of shoulder straps, a waist belt, and a belt connector.

15 Claims, 6 Drawing Sheets

JUGGLING PRACTICE TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of educational devices related to physical education, more specifically, a training device adapted for use in juggling.

Summary of Invention

The juggling practice tool is a device that is designed to collect objects that are dropped in the course of practicing juggling. The juggling practice tool is a catch basin that is worn by the juggler during the practice session. The catch basin is attached to the juggler through the use of a plurality of shoulder straps, a waist belt, and a belt connector. The plurality of shoulder straps and the waist belt hold the catch basin perpendicular to the plane of juggling in such a way that when a juggled object is dropped the catch basin catches and hold the dropped juggled object in a location readily accessible to the juggler.

These together with additional objects, features and advantages of the juggling practice tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the juggling practice tool in detail, it is to be understood that the juggling practice tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the juggling practice tool.

It is therefore important that the claims be regarded as including such equivalent construction insofar as they do not depart from the spirit and scope of the juggling practice tool. It is also to be understood that the phraseology and terminology employed herein are for purposes of description and should not be regarding as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

Figure 1:
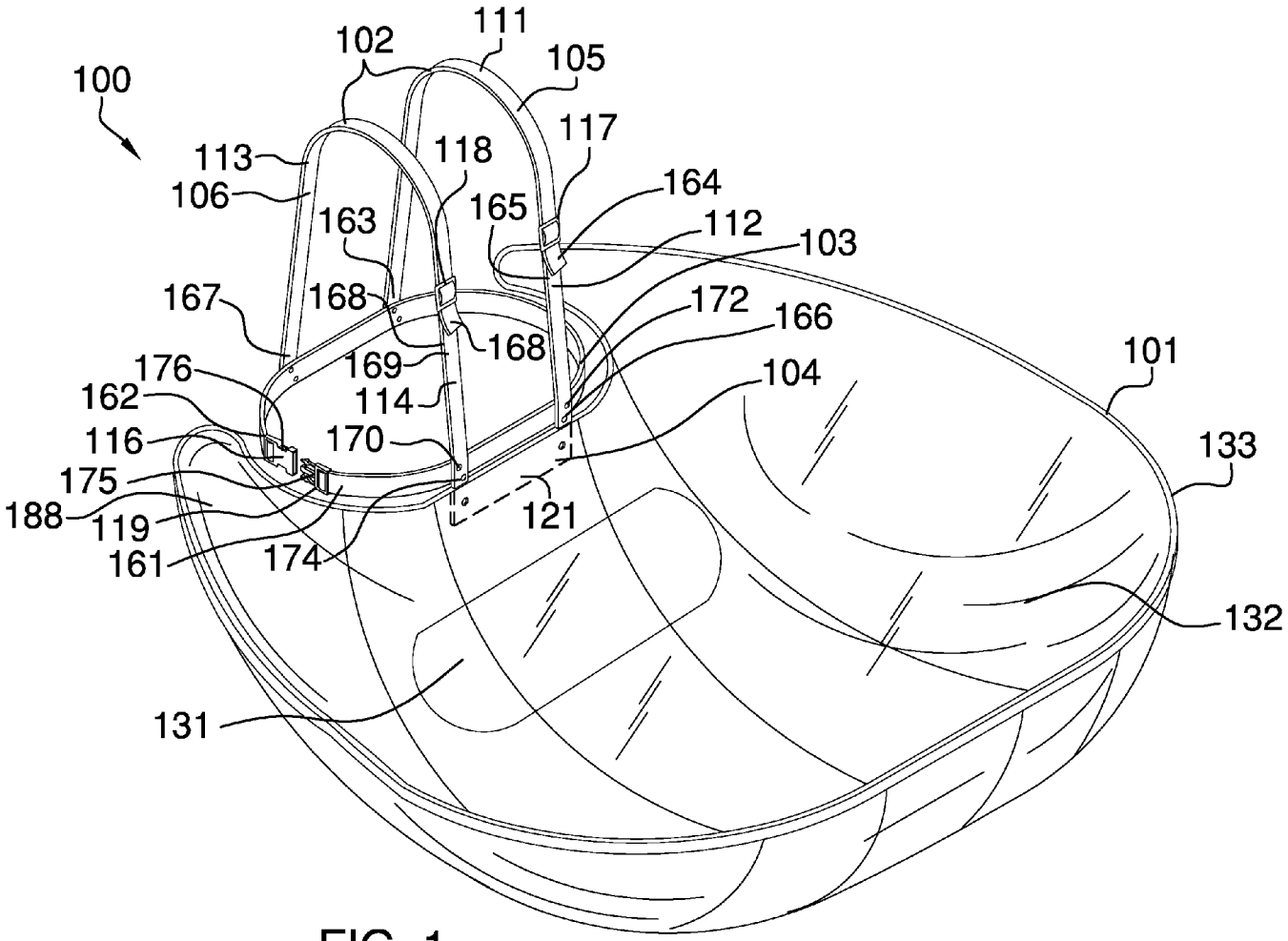
FIG. 1 is a perspective view of an embodiment of the disclosure.
Figure 2:
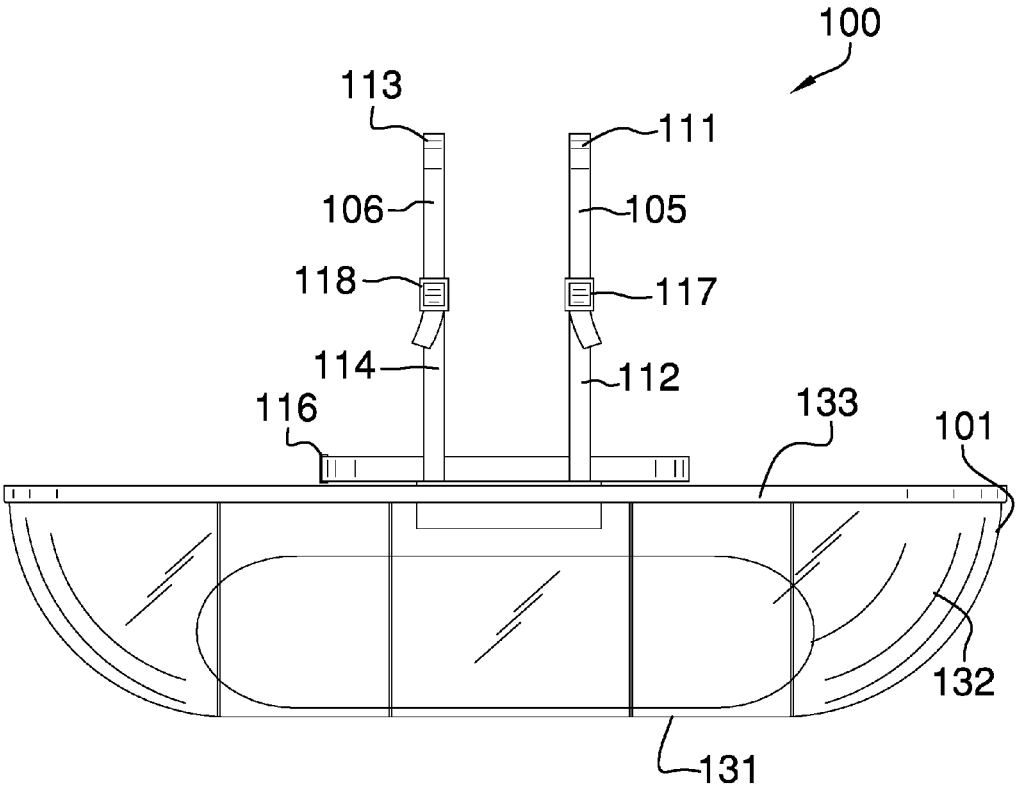
FIG. 2 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7. The juggling practice tool 100 (hereinafter invention) comprises a catch basin 101, a plurality of shoulder straps 102, a waist belt 103, and a belt connector 104.

The catch basin 101 is a container. The catch basin 101 is formed in the shape of a generally oval bowl and further comprises a bottom 131, a concave chute 132, and a lip ring 133. The bottom 131 of the catch basin 101 is a flat surface that acts as the supporting surface to receive dropped juggled items 141. The catch area 134 of the catch basin 101 is defined by the lip ring 133. The catch area 134 is the area wherein if a dropped juggled item 141 falls within the catch area 134 the dropped juggled item 141 will be captured by the catch basin 101. The lip ring 133 is the edge of the catch basin 101 and forms the overall shape of the catch area 134. The concave chute 132 is a sloped surface that guides the dropped juggled items 141 that fall within the catch area 134 to the bottom 131 of the catch basin 101. When viewed through the catch area 134, the curve of the concave chute 132 resembles the interior surface of an ellipsoid. The catch basin 101 is made of a transparent material for safety reasons, a juggler 142 needs to be able to see the ground to avoid tripping and falling. The catch basin 101 can be formed as a single unit from molded plastic. Suitable plastics include, but are not limited to, poly(methyl methacrylic) or polycarbonate.

The catch basin 101 may be further defined with side members 188 that extend to sides of the juggler 142. The side members 188 are protrusions that extend rearwardly from the otherwise generally ovular shape of the catch area 134. The side members 188 merely extend the catch area 134 in order to collect dropped juggle items 141 that are errantly dropped to either side of the juggler 142. The lip ring 133 extends around both side members 188 as well as across the catch area 134.

The catch basin 101 is supported by the juggler 142 during practice sessions such that the catch area 134 of the catch basin 101 is underneath the space within which the juggler 142 is practicing. The juggler 142 supports the catch basin 101 through the use of the plurality of shoulder straps 102, the waist belt 103, and the belt connector 104.

Figure 3:
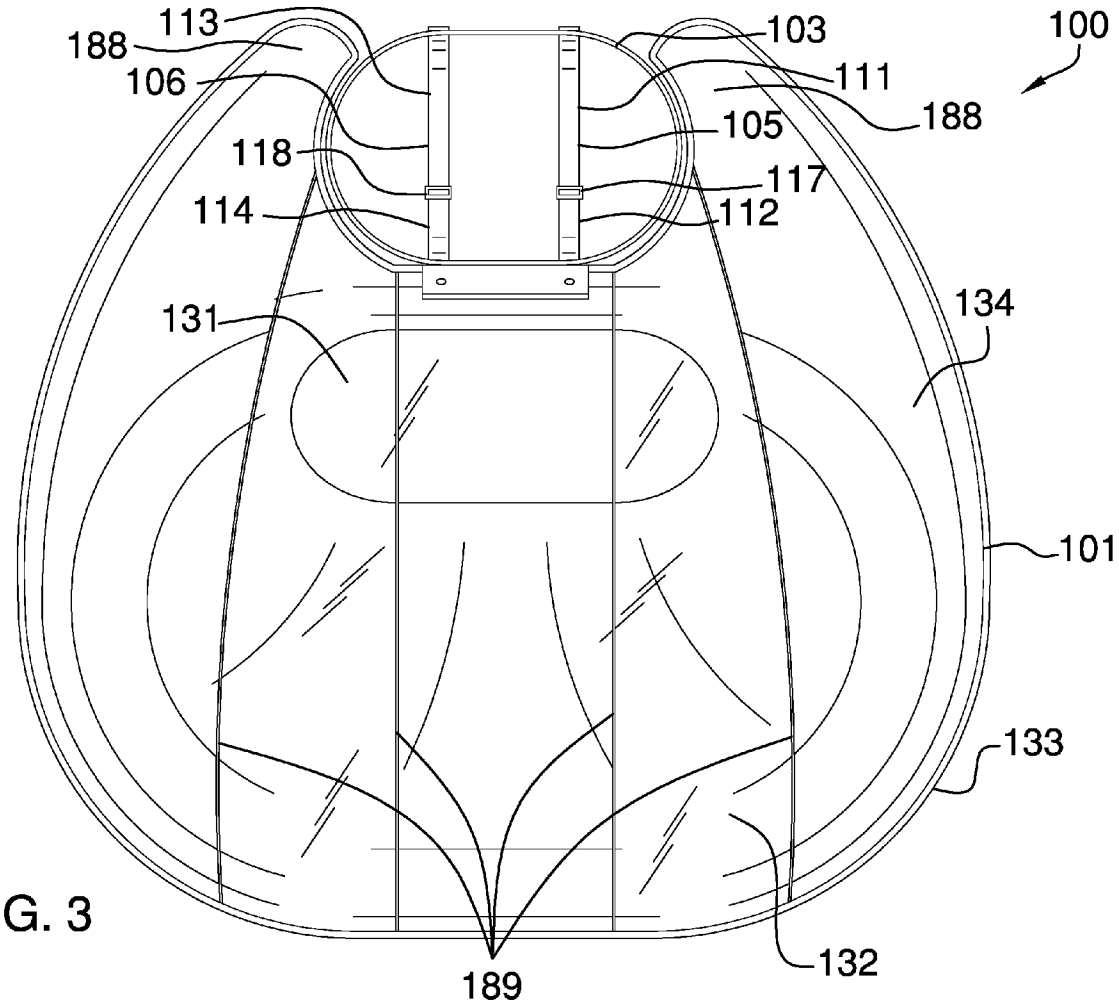
FIG. 3 is a bottom view of an embodiment of the disclosure.
Figure 4:
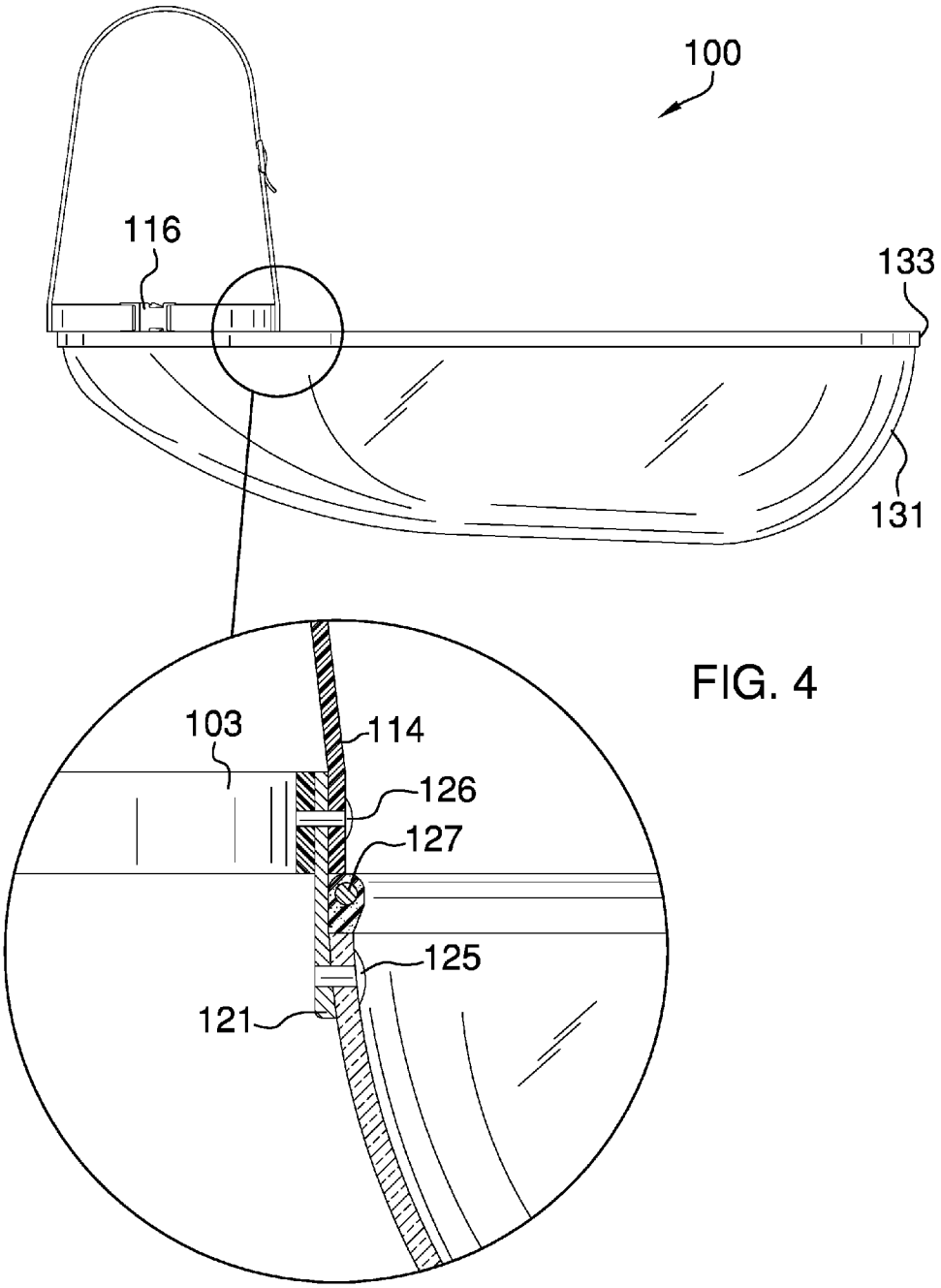
FIG. 4 is a side view of an embodiment of the disclosure.
Figure 5:
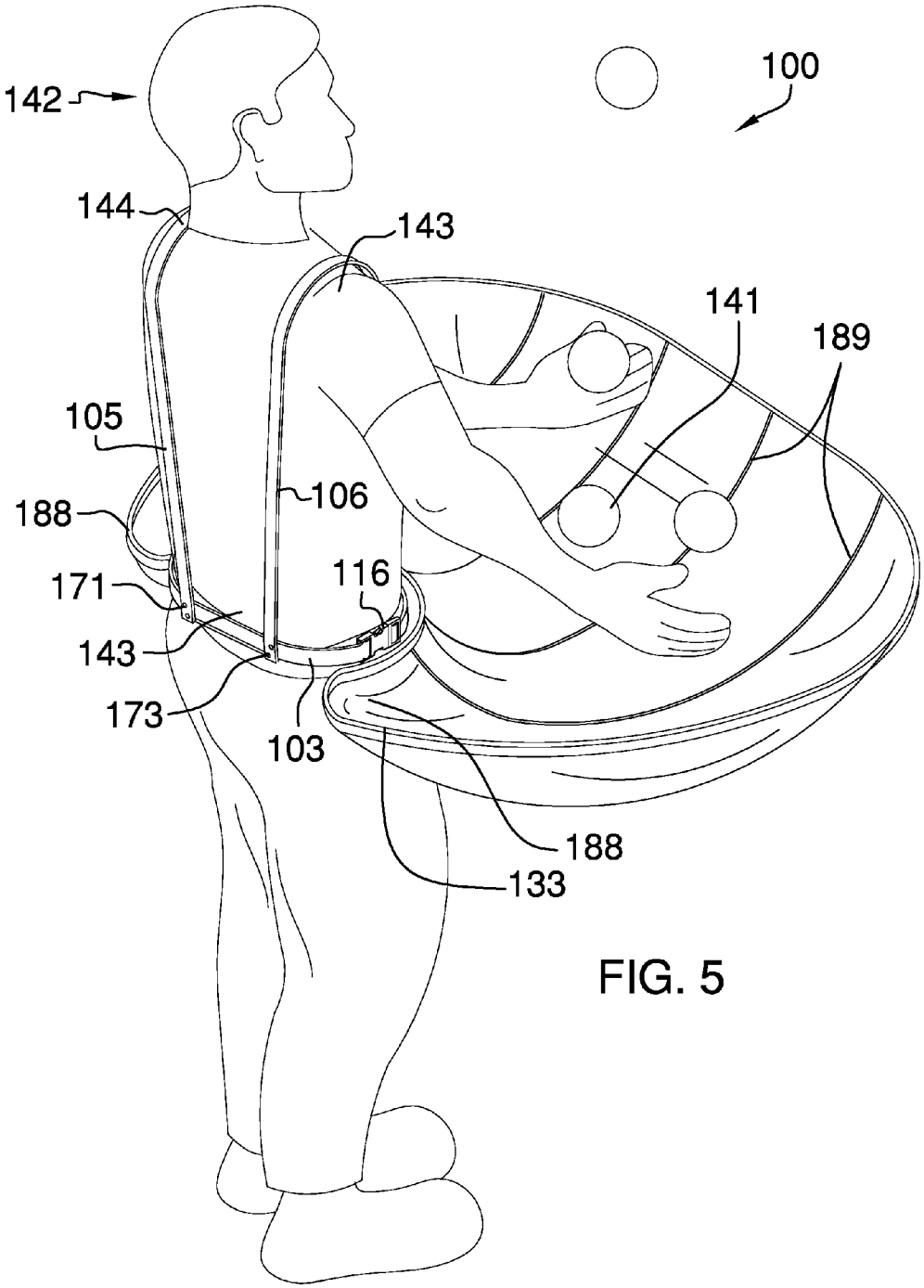
FIG. 5 is an in use view of an embodiment of the disclosure.
Figure 6:
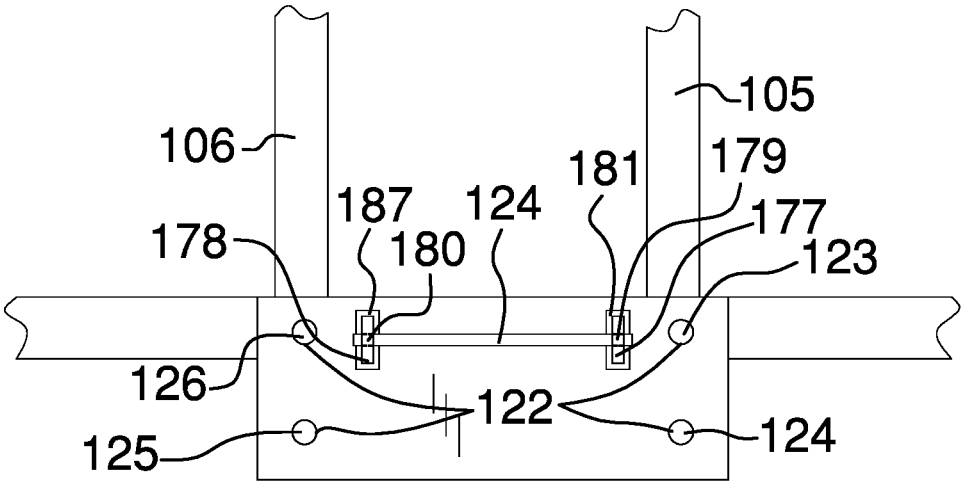
FIG. 6 is a detail view of an embodiment of the disclosure.
Figure 7:
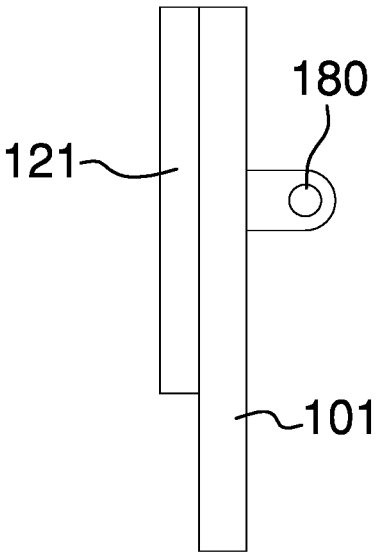
FIG. 7 is a detail view of an embodiment of the disclosure.

The catch basin 101 may be further defined with a plurality of reinforcing ribs 189 that are integrated into the construction of the catch basin 101. The plurality of reinforcing ribs 189 are generally parallel with one another, but extend away from the juggler 142. Referring to FIG. 3, the plurality of reinforcing ribs 189 are provided on the catch area 134 portion of the catch basin 101.

The waist belt 103 is a piece of webbing that is used to secure the invention 100 around the waist 143 of the juggler 142. The waist belt 103 is further defined with a first end 161 and a second end 162. A buckle 116 is used to attach the first end 161 to the second end 162. The buckle 116 is a commercially available quick release buckle that is further defined with a male connector 175 and a female connector 176. The male connector 175 is attached to the first end 161. The female connector 176 is attached to the second end 162. The selected buckle 116 incorporates a third ring and loop slider 119 that is used to adjust the length of the waist belt 103 so that it fits around the waist 143 of the juggler 142.

The plurality of shoulder straps 102 further comprises a first shoulder strap 105 and a second shoulder strap 106. The purpose of the plurality of shoulder straps 102 is to support the invention 100 using the left shoulder 144 and the right shoulder 145 of the juggler 142.

The first shoulder strap 105 further comprises a first strap 111, a second strap 112 and a first ring and loop slider 117. The first strap 111 is further defined with a third end 163 and a fourth end 164. The second strap 112 is further defined with a fifth end 165 and a sixth end 166. As most clearly shown in FIGS. 1 and 2, the third end 163 of the first strap 111 is joined to the waist belt 103 using a first joint 171. The sixth end 166 of the second strap 112 is joined to the waist belt 103 using a second joint 172. The fourth end 164 of the first strap 111 and the fifth end 165 of the second strap 112 are joined using the first ring and loop slider 117. By adjusting the first ring and loop slider 117, the fit of the first shoulder strap 105 can be adjusted to the juggler 142. The first joint 171 and the second joint 172 can be formed in several ways including, but not limited to, sewn seams, glue, or rivets. The first shoulder strap 105 is designed to go over the left shoulder 144.

The second shoulder strap 106 further comprises a third strap 113, a fourth strap 114 and a second ring and loop slider 118. The third strap 113 is further defined with a seventh end 167 and an eighth end 168. The fourth strap 114 is further defined with a ninth end 169 and a tenth end 170. As most clearly shown in FIGS. 1 and 2, the seventh end 167 of the third strap 113 is joined to the waist belt 103 using a third joint 173. The tenth end 170 of the fourth strap 114 is joined to the waist belt 103 using a fourth joint 174. The eighth end 168 of the third strap 113 and the ninth end 169 of the fourth strap 114 are joined using the second ring and loop slider 118. By adjusting the second ring and loop slider 118, the fit of the second shoulder strap 106 can be adjusted to the juggler 142. The third joint 173 and the fourth joint 174 can be formed in several ways including, but not limited to, sewn seams, glue or rivets. The second shoulder strap 106 is designed to go over the right shoulder 145.

The belt connector 104 is a device that is used to attach the catch basin 101 to the waist belt 103, and the plurality of shoulder straps 102. The belt connector 104 further comprises a support plate 121, a plurality of rivets 122, and a mounting pin 127. The support plate 121 is a steel plate that is used to anchor the invention 100 together. The support plate 121 has a first flange 177 and a second flange 178. Both the first flange 177 and the second flange 178 project perpendicularly away from the support plate 121 in the direction away from the juggler 142. The first flange 177 has formed in it a first pin hole 179 and a second pin hole 180. The first flange 177 and the second flange 178 are sized to fit through a first flange hole 181 and a second flange hole 182 respectively. The first flange hole 181 and the second flange hole 182 are holes formed within the catch basin 101. Once the first flange 177 and the second flange 178 are positioned through the first flange hole 181 and the second flange hole 182 respectively, the support plate 121 is secured to the catch basin 101 by securing the mounting pin 127 through both the first pin hole 179 and the second pin hole 180. The mounting pin 127 is a steel shaft that is sized to fit through both the first pin hole 179 and the second pin hole 180.

The plurality of rivets 122 further comprises a first rivet 123, a second rivet 124, a third rivet 125, and a fourth rivet 126. In the final assembly of the first potential embodiment of the disclosure, the first rivet 123 secures the second strap 112, the support plate 121 and the waist belt 103 together. The second rivet 124 and third rivet 125 are used to secure the catch basin 101 to the support plate 121. The fourth rivet 126 secures the fourth strap 114, the support plate 121 and the waist belt 103 together.

To use the invention 100, the buckle 116 is released and the first shoulder strap 105 is placed over the left shoulder 144 and the second shoulder strap 106 is placed over the right shoulder 145. The buckle 116 is closed and the first ring and loop slider 117, second ring and loop slider 118, and third ring and loop slider 119 are adjusted for the comfort of the juggler 142. The juggler 142 then juggles normally.

The following definitions were used in this disclosure:

Buckle: As used in this disclosure, a buckle is a fastening that is used for joining a first loose end of a strap to a second loose end of the same strap or a different strap. A buckle further comprises a male connector that is attached to a first loose end and a female connector that is attached to a second loose end. The male connector has a pin or other structure that is generally caught by a structure formed in the female connector.

Ellipsoid: As used in this definition, an ellipsoid is a three geometric surface whose planar sections are elliptical or circular.

Strap: As used in this disclosure a strap is a strip of leather, cloth, or other flexible material, often with a buckle, that is used to fasten, secure, carry, or hold onto something.

Textile: As used in this disclosure, a textile is a material that is woven, knitted, or felted. Synonyms in common usage for this definition include fabric and cloth.

Webbing: As used in this disclosure, a webbing is strong, close woven or knitted fabric that is used for straps or belting. As used in this disclosure, webbing is a fully formed material that is only cut for to length for use. Webbing is not formed by cutting broader materials into strips.

With respect to the above description, it is to be realized that the optimum dimensional relationship for the various components of the invention described above and in FIGS.

1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A training device comprising:

a catch basin, a plurality of shoulder straps, a waist belt, and a belt connector;

wherein the training device is adapted for use in juggling;

wherein the training device is adapted to be worn by a juggler;

wherein the catch basin is a concave structure;

wherein the catch basin is adapted to be supported in front of the juggler;

wherein the catch basin captures dropped juggled items that fall within a catch area;

wherein the catch basin is a container formed in the shape of a bowl;

wherein the catch basin further comprises a bottom, a concave chute, and a lip ring;

wherein the bottom of the catch basin is a flat surface;

wherein the concave chute is a sloped surface that guides the dropped juggled items that fall within the catch area to the bottom of the catch basin;

wherein the viewed through the catch area, the curve of the concave chute is formed in the shape of the interior surface of an ellipsoid;

wherein the catch basin is made of a transparent material;

wherein the catch basin is further defined with side members that are adapted to extend to sides of the juggler;

wherein the side members are protrusions that extend rearwardly from the otherwise generally ovular shape of the catch area;

wherein the side members extend the catch area in order to adaptively collect dropped juggle items that are errantly dropped to either side of the juggler;

wherein the lip ring extends around both side members as well as across the catch area.

2. The training device according to claim 1 wherein the catch basin is further defined with a plurality of reinforcing ribs that are integrated into the construction of the catch basin; wherein the plurality of reinforcing ribs are generally parallel with one another, and are adapted to extend away from the juggler; wherein the plurality of reinforcing ribs are provided on the catch area portion of the catch basin, and provide increased rigidity to the catch basin.

3. The training device according to claim 2 wherein the waist belt comprises a webbing and a buckle;

wherein waist belt is further defined with a first end and a second end wherein the buckle is further defined with a male connector and a female connector;

wherein the is attached to the first end;

wherein the female connector is attached to the second end.

4. The training device according to claim 3 wherein the plurality of shoulder straps further comprises a first shoulder strap and a second shoulder strap.

5. The training device according to claim 4 wherein the the first shoulder strap further comprises a first strap, a second strap and a first ring and loop slider;

wherein the first strap is further defined with a third end and a fourth end;

wherein the second strap is further defined with a fifth end and a sixth end;

wherein the second shoulder strap further comprises a third strap, a fourth strap and a second ring and loop slider;

wherein the third strap is further defined with a seventh end and an eighth end;

wherein the fourth strap is further defined with a ninth end and a tenth end.

6. The training device according to claim 5 wherein the third end of the first strap is joined to the waist belt using a first joint;

wherein the sixth end of the second strap is joined to the waist belt using a second joint;

wherein the seventh end of the third strap is joined to the waist belt using a third joint;

wherein the tenth end of the fourth strap is joined to the waist belt using a fourth joint the eighth end of the third strap and the ninth end of the fourth strap are joined using the second ring and loop slider.

7. The training device according to claim 6 wherein the fourth end of the first strap and the fifth end of the second strap are joined using a first ring and loop slide;

wherein the eighth end of the third strap and the ninth end of the fourth strap are joined using the second ring and loop slider.

8. The training device according to claim 7 wherein the first joint, second joint, third joint, and fourth joint are joined using a method selected from the group of methods consisting of sewn seams, glue, or rivets.

9. The training device according to claim 8 wherein the buckle incorporates a third ring and loop slider.

10. The training device according to claim 9 wherein the belt connector further comprises a support plate, a plurality of rivets, and a mounting pin.

11. The training device according to claim 10 wherein the support plate is a steel plate.

12. The training device according to claim 11 wherein the support plate is formed with a first flange and a second flange.

13. The training device according to claim 12 wherein the catch basin is attached to the support plate using the first flange, the second flange and a mounting pin.

14. The training device according to claim 13 wherein the plurality of rivets further comprises a first rivet, a second rivet, a third rivet, and a fourth rivet.

15. The training device according to claim 14 wherein the first rivet secures the second strap, the support plate and the waist belt;

wherein the second rivet is used to secure the catch basin to the support plate;

wherein the third rivet is used to secure the catch basin to the support plate;

wherein the fourth rivet secures the fourth strap, the support plate and the waist belt.

* * * * *